US007510513B2

(12) United States Patent
De Figueiredo Silva

(10) Patent No.: US 7,510,513 B2
(45) Date of Patent: Mar. 31, 2009

(54) APPARATUS FOR IN-WATER EXERCISES

(75) Inventor: Antonio Augusto Dias De Figueiredo Silva, Palmital-SP (BR)

(73) Assignee: Sahinco Ind. Com. E Representacoes Ltda, Palmital-SP (BR)

( * ) Notice: Subject to any disclaimer, the term of this patent is extended or adjusted under 35 U.S.C. 154(b) by 0 days.

(21) Appl. No.: 11/722,946

(22) PCT Filed: Jan. 6, 2006

(86) PCT No.: PCT/BR2006/000001

§ 371 (c)(1),
(2), (4) Date: Jul. 23, 2007

(87) PCT Pub. No.: WO2006/072156

PCT Pub. Date: Jul. 13, 2006

(65) Prior Publication Data

US 2008/0103029 A1 May 1, 2008

(30) Foreign Application Priority Data

Jan. 7, 2005 (BR) ..... 0500083

(51) Int. Cl.
*A63B 21/008* (2006.01)
*A63B 22/08* (2006.01)

(52) U.S. Cl. ..... 482/113; 482/58

(58) Field of Classification Search ..... 482/51–59, 482/63, 72, 73, 111–113, 909; 280/829; 244/101; 446/153, 156, 163, 164; 472/13, 472/128, 129; 415/61, 122.1, 123, 124, 124.2; 417/231, 233; 418/13, 69, 212; *A63B 69/16, A63B 21/008, 22/06, 22/08*

See application file for complete search history.

(56) References Cited

U.S. PATENT DOCUMENTS

| | | | | | |
|---|---|---|---|---|---|
| 2,504,007 | A | * | 4/1950 | Declercq | 463/60 |
| 2,725,231 | A | * | 11/1955 | Hoover | 482/73 |
| 4,421,452 | A | * | 12/1983 | Rougemont | 415/4.2 |
| 4,515,533 | A | * | 5/1985 | Gomez | 417/319 |
| 4,579,335 | A | * | 4/1986 | Centafanti | 482/54 |
| 4,979,735 | A | * | 12/1990 | Stewart | 482/113 |
| 5,110,118 | A | * | 5/1992 | Winey | 482/73 |
| 5,558,604 | A | | 9/1996 | Hopkins | |

FOREIGN PATENT DOCUMENTS

| | | |
|---|---|---|
| DE | 3447829 | 7/1986 |
| DE | 10308267 | 9/2004 |
| EP | 0803270 | 10/1997 |
| EP | 1020205 | 7/2000 |

* cited by examiner

*Primary Examiner*—Loan H Thanh
*Assistant Examiner*—Oren Ginsberg
(74) *Attorney, Agent, or Firm*—Darby & Darby

(57) ABSTRACT

APPARATUS FOR IN-WATER EXERCISES, comprising; —a structure to be submerged in a body of water; an actuator mechanism movable through the user's effort; a pump comprising a housing fixed to the structure and journalling a shaft on to which at least one first rotor is mounted coupled to the shaft, at a first housing portion, said shaft being coupled to the actuator mechanism, whereby to be rotationally driven, to pump water; a water collector coupled to the first portion of the housing to receive part of the water pumped by the first rotor; and a metering means comprising at least one first display fixed onto the structure and coupled to the water collector, whereby to indicate at least on of the outflow and volume of water pumped through the pump and, thus, the respective operation speed and/or the amount of exercise being practiced.

13 Claims, 16 Drawing Sheets

APPARATUS FOR IN-WATER EXERCISES

Cross Reference to Prior Application

This application is a U.S. national phase of International Application No. PCT/BR2006/00000 1, filed Jan. 6, 2006, which claims priority from Brazilian Patent Application No. PI0500083-1, filed Jan. 7, 2005, the disclosure of both are incorporated herein by reference in their entirety.

FIELD OF THE INVENTION

The present invention refers to an apparatus for exercises to be operated underwater in a swimming-pool or another body of water and operated by means of human drive force through motion of a pedal, handle, cable, treadmill or another transmission device coupled therewith, to allow that a person may practice seated pedaling (such as on a bicycle), treading (such as on an elliptical rotation apparatus or on a treadmill), rotating a handle, pulling a cable coupled to a rod (such as in a rowing motion), or any other exercise that might be practiced on an apparatus for physical exercises usable underwater, and allowing that the speed of the exercise practiced by the user and a corresponding "total course" be measured.

PRIOR-ART

It has been known for a long time that physical activities are important to provide for and preserve good health, mainly if particulars of modern life associated to idleness, unhealthy nourishment, psychological pressure (stress) and great competitiveness are taken into account.

Among physical activities recommended by professionals in health, emphasis is given to physical exercises practiced on dry ground or on gymnastics apparatuses such as treadmills, stationary bicycles, ellipses (which permit low impact rotary motion treading), rowing apparatuses (which simulate this activity), stepping (which simulates climbing a staircase) and the like, which are widely used in sports clubs, gymnastics academies and even in residences.

On the other hand, the benefits of in-water exercises are also known. Water provides an important support for the fluctuation of the body of a person who is exercising himself in a partially submerged condition, permitting that individuals carrying various deficiencies such as overweight and fragilities or deficient control of upper and lower members and even of the torso, may accomplish physical maintenance or health condition rehabilitation exercises, in post-operative and physiotherapy treatments. The fluctuation support promoted by water, as well as the resistance and refreshment offered thereby, provide for remarkable results, without submitting the individual to impact on his articulations.

The practice of exercises on underwater apparatuses is already known in the art. Bicycles, treadmills and other apparatuses driven mechanically by human force action are already widely used. However, the apparatuses known to date use vanes or paddles, coupled to pedals, treadmills or other motion-transmitting mechanisms, in an attempt to impose a resistance to this motion accomplished by the individual in the water. Such vanes or paddles provide just a relative opposition to this motion, since their area cannot be modified and the flow they generate is not contained, not generating outflow, but only turmoil therearound. Furthermore, it is impossible do "measure" the operation speed or the required effort, if no other electronic or mechanical means to measure rotation are used.

Hence, the in-water exercise apparatuses known up to date present the drawback of not permitting that the required effort be increased or that this effort and the operation speed be measured using only the water displacement generated by the apparatus itself.

OBJECTS OF THE INVENTION

In view of the above-mentioned deficiencies and relative to the prior-art apparatuses, it is an object of the present invention to provide an apparatus for in-water exercises, particularly driven by the exerciser's effort, producing a variable and measurable outflow water flow, whereby to allow determining, through the water flow generated by the operation of the apparatus, the speed and the effort resulting from the physical exercise being accomplished.

It is another object of the present invention to provide an apparatus as mentioned above and presenting a simple and resistant construction, requiring little maintenance and presenting low cost.

A further object of the present invention is to provide an apparatus as mentioned above featuring simple and low cost maintenance.

SUMMARY OF THE INVENTION

These and other objects of the present invention are achieved through the provision of an apparatus for in-water exercises, comprising: a structure to be at least partially submerged in a body of water; an actuator mechanism coupled to the structure and movable through the user's effort; a pump submerged in the body of water and comprising a housing fixed to the structure and internally journalling a shaft on to which at least one first rotor is mounted coupled to the shaft, at a first housing portion, said shaft being coupled to the actuator mechanism, whereby to be rotationally driven, to pump water; a water collector coupled to the first portion of the housing of the pump, to receive part of the water pumped by the first rotor; and a metering means comprising at least one first display fixed onto the structure and coupled to the water collector, whereby to indicate at least on of the outflow and volume of water pumped through the pump and, thus, at least one of the respective operation speed and amount of exercise being practiced.

The apparatus of the present invention allows that the user's efforts be measured, utilizing therefor means related exclusively to the water flow generated by the exercise.

According to a particular construction, the apparatus object of the present invention presents a shift mechanism that selects "speeds", as in a vehicle, wherein each "speed" corresponds to a rotor of the pump which is engaged with the shaft of the same, passing through a free rotation position on the pump shaft, and a position engaging the same, causing that said rotor initiates pumping water. This shift system is formed from an actuating lever; intermediate rods; a shifting lever; a guide-key displaceable sliding within a longitudinal key bed in the pump shaft and, over this guide-key, fixed in sequence, the actuating keys, in the same number as the rotors minus one, articulated with the guide-key at one end, through a pin and pressed, at the other end, by a spring radially biasing them outwards from the pump shaft; compressing rings, in the same number as the actuating keys, maintaining them pressed against the pump shaft and leaving the corresponding rotor free when the speed-shifting lever is in the inoperative position relative to the corresponding rotor.

The apparatus of the present invention comprises, in a particular construction, a pumped water collecting and conducting system, wherein the first display of the measuring means comprises two graduated transparent cups, one to measure the pedaling speed and the other which accumulates water, simulating a speedometer, i.e., the measurement of a virtual course. This display system has also a register, where the directing of the pumped water can be selected, said water being able to be directed, for instance, to a fountain or a squirt, thus also providing a source of entertainment for the users, apart from the low impact physical exercise.

BRIEF DESCRIPTION OF THE DRAWINGS

The invention will now be described, reference being made to the attached drawings, given as an example of one embodiment of the invention when applied to an aquatic bicycle and wherein.

Figure 5:
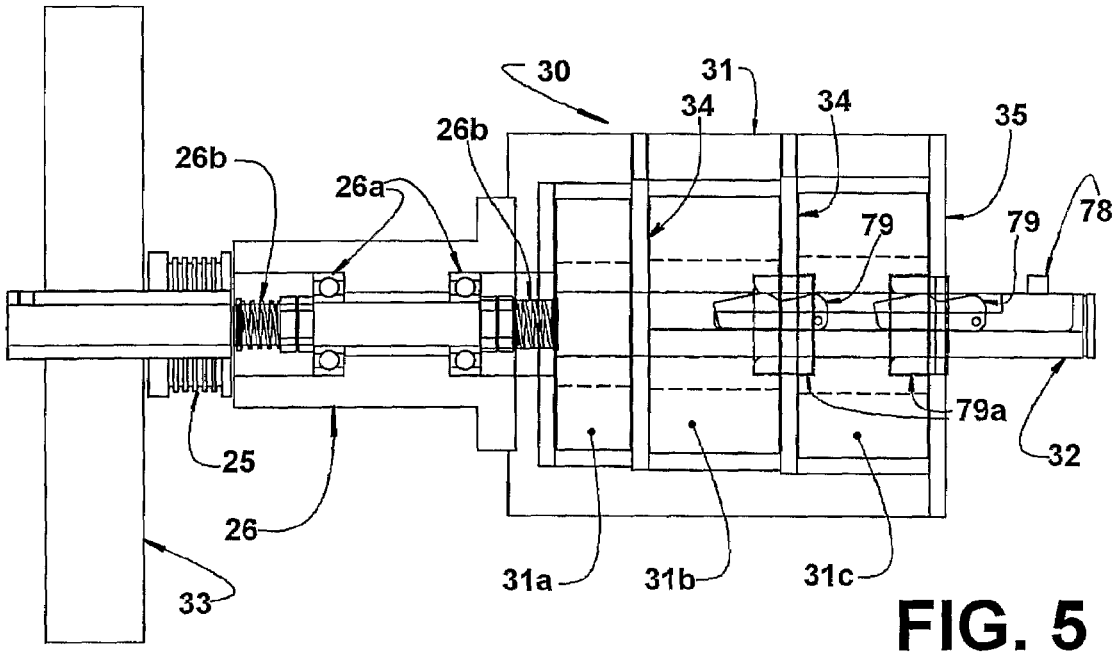
FIG. 5 represents a sectional view of the pump shown in FIG. 4, wherein, according to this example, a 3-stage pump was used, with the first rotor engaged with the shaft and the other rotors being susceptible to engagement/disengagement.
Figure 8A:
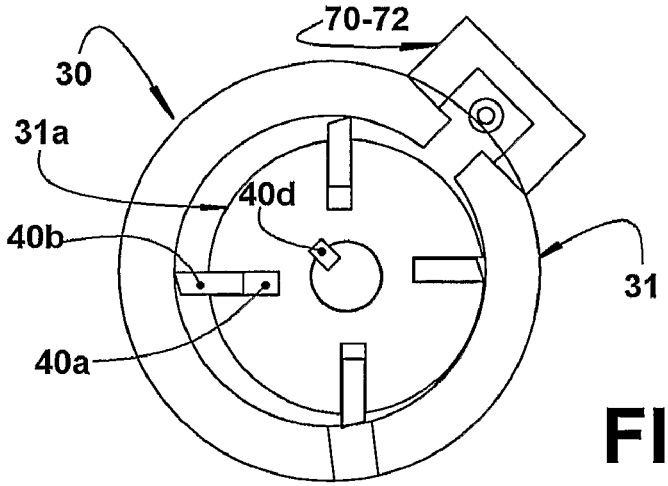
Figure 8B:
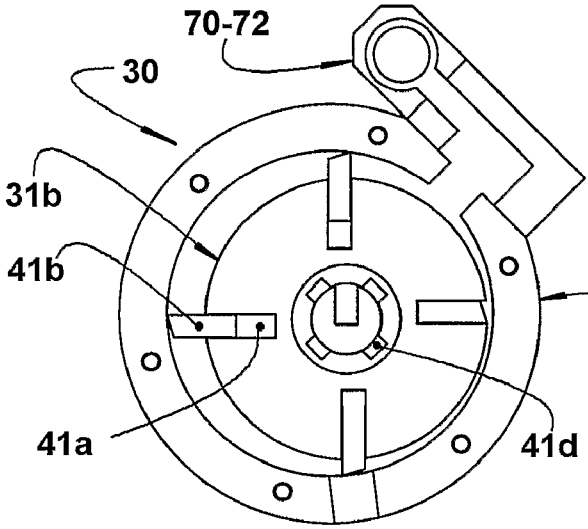
Figure 8C:
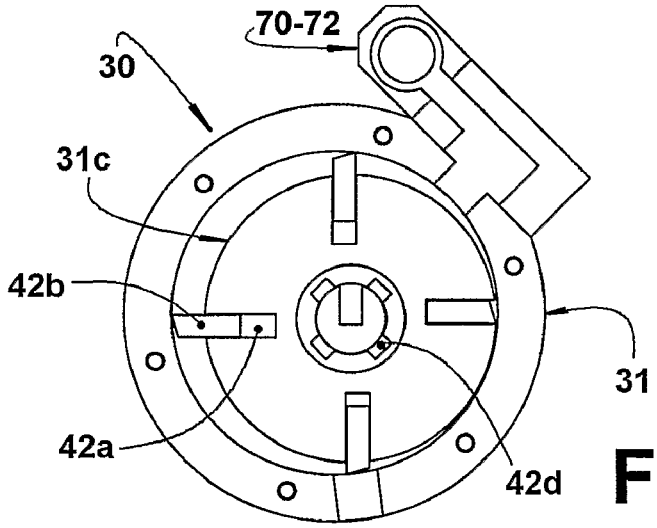
Figure 9:
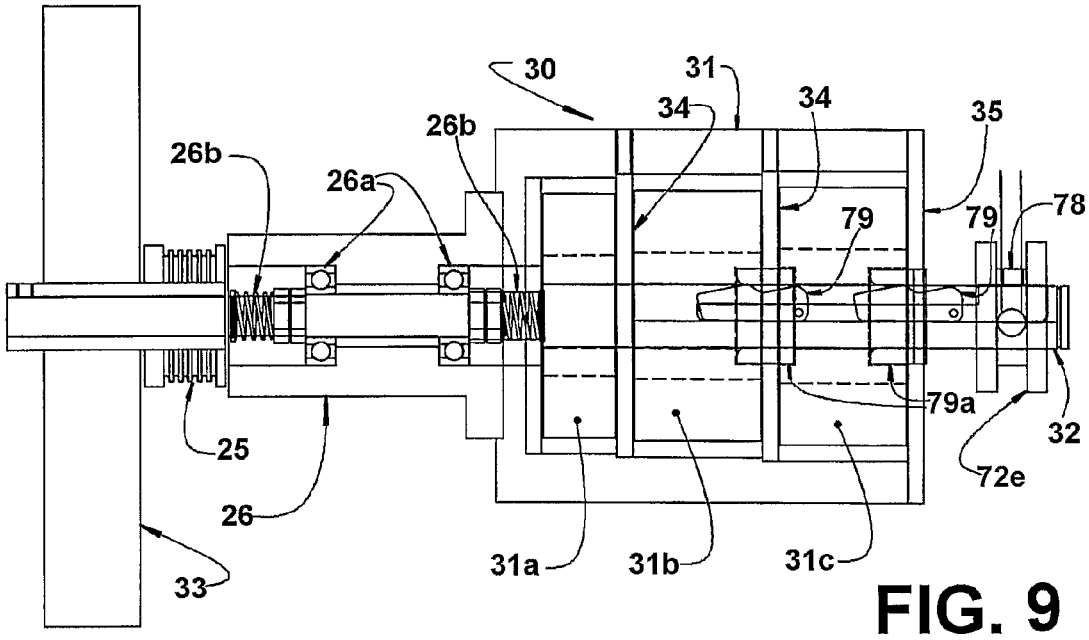
Figure 10:
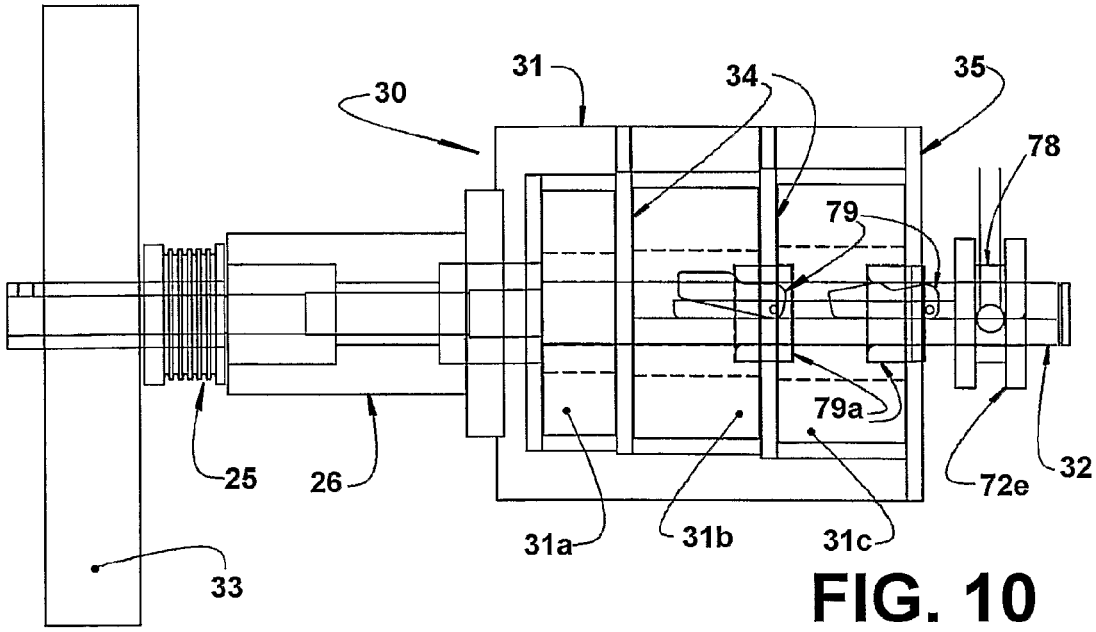
Figure 11:
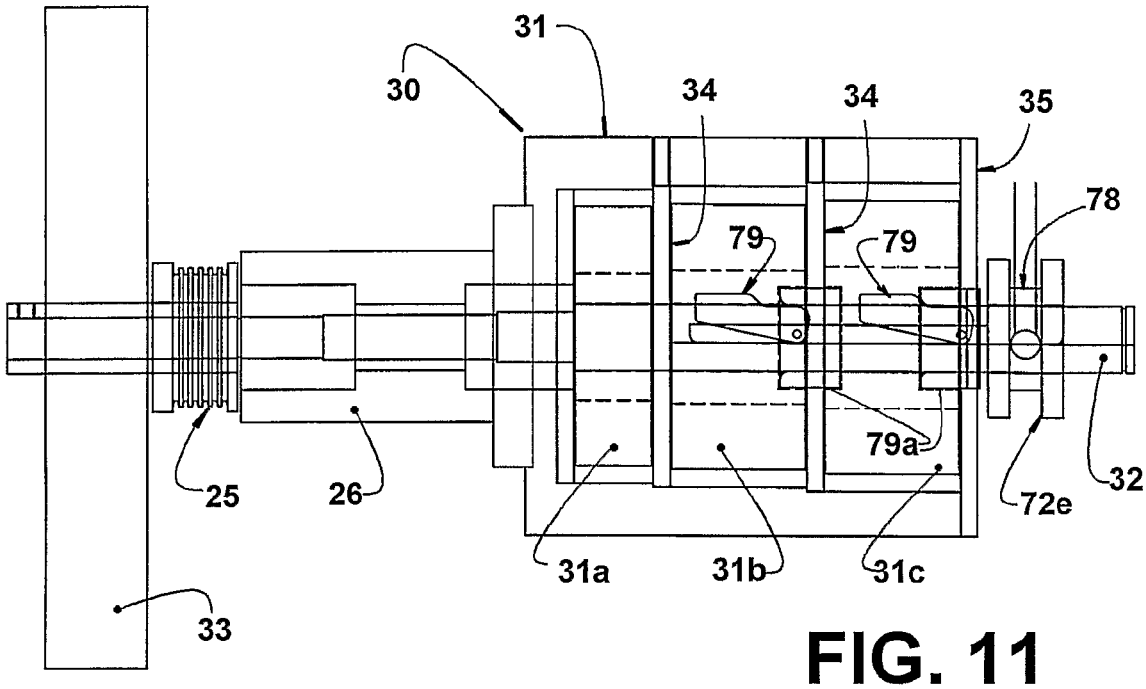
Figure 12:
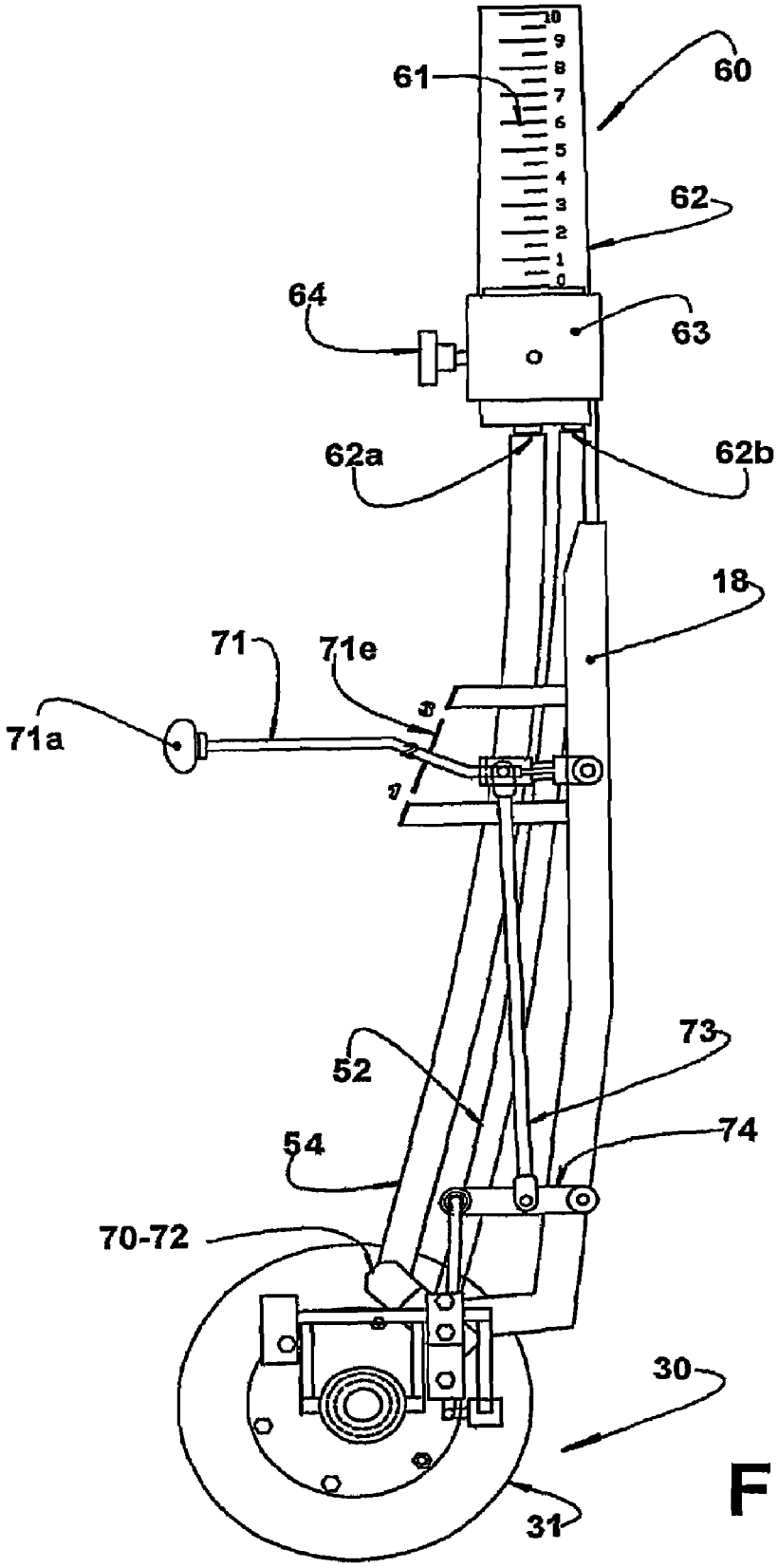
Figure 13:
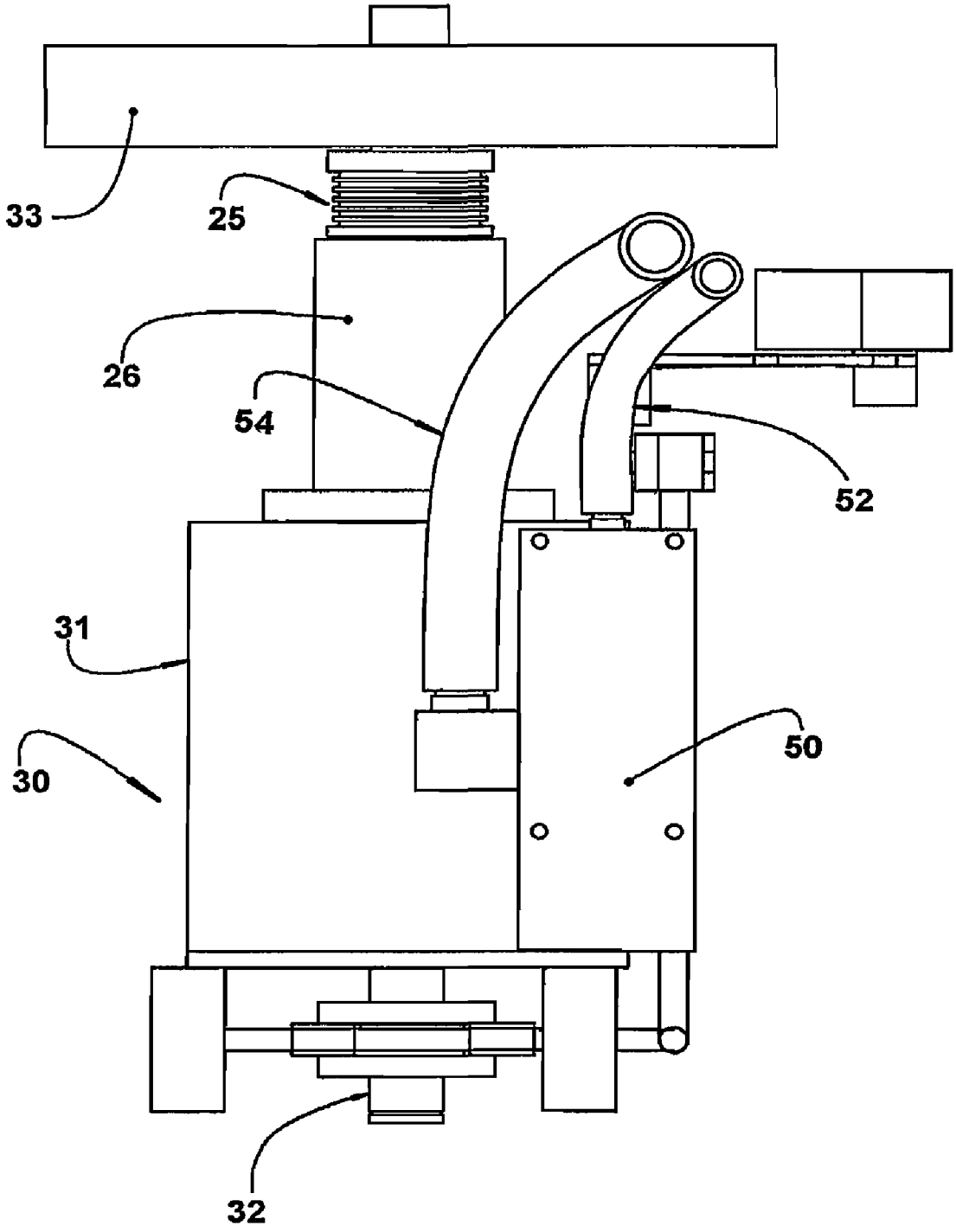
Figure 14:
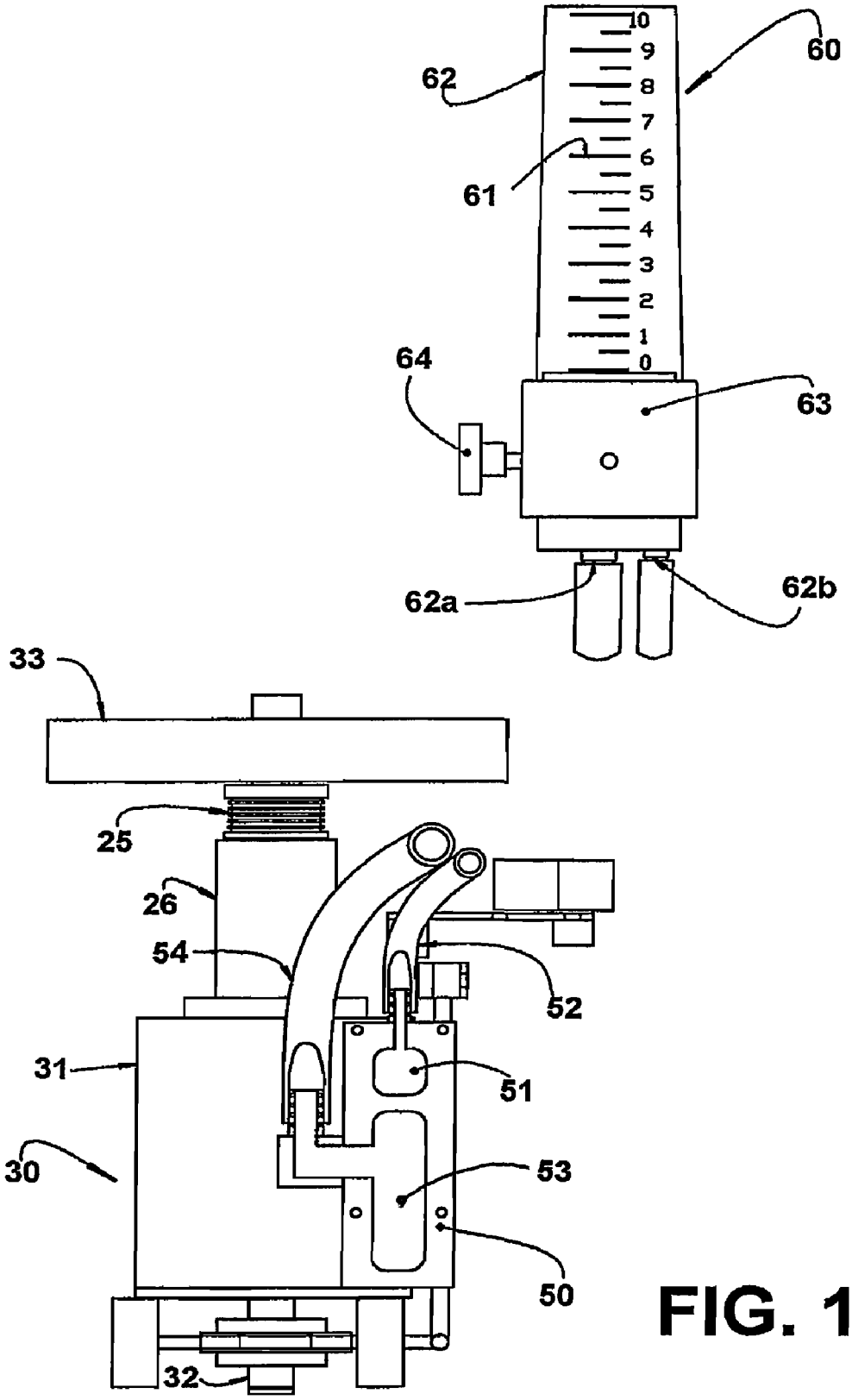
Figure 15:
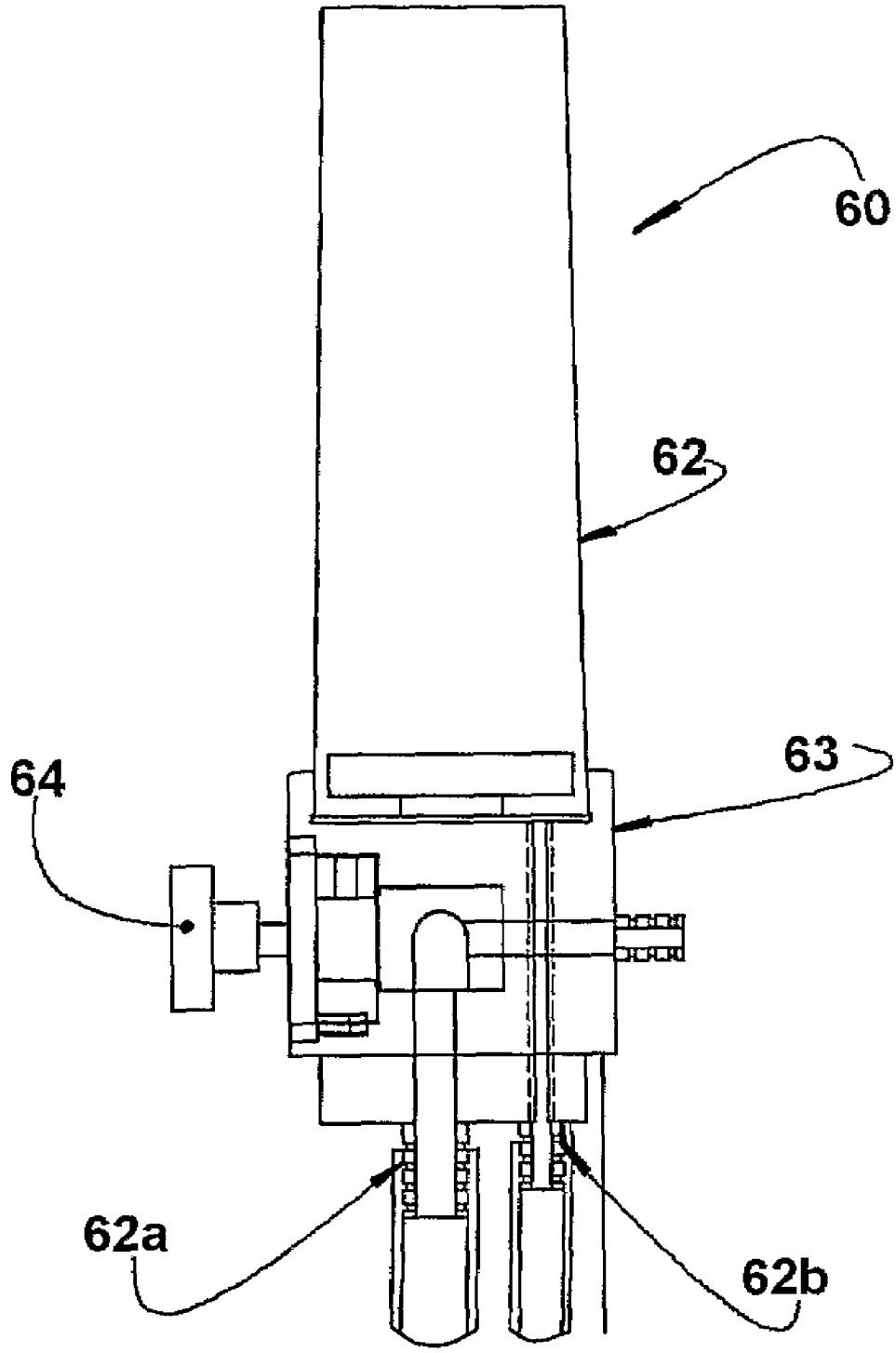
Figure 17:
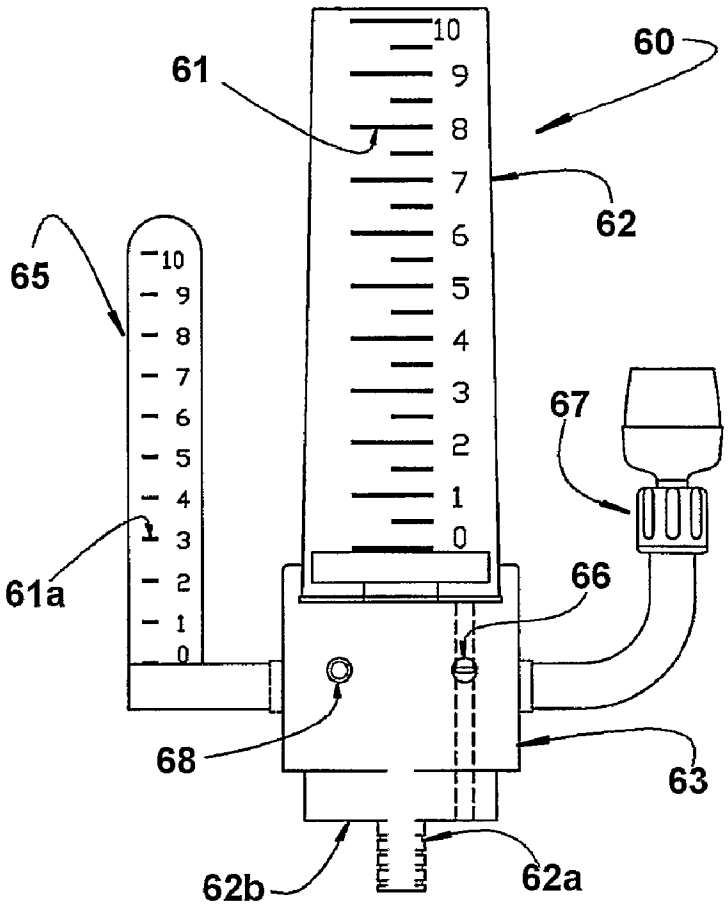
Figure 16:
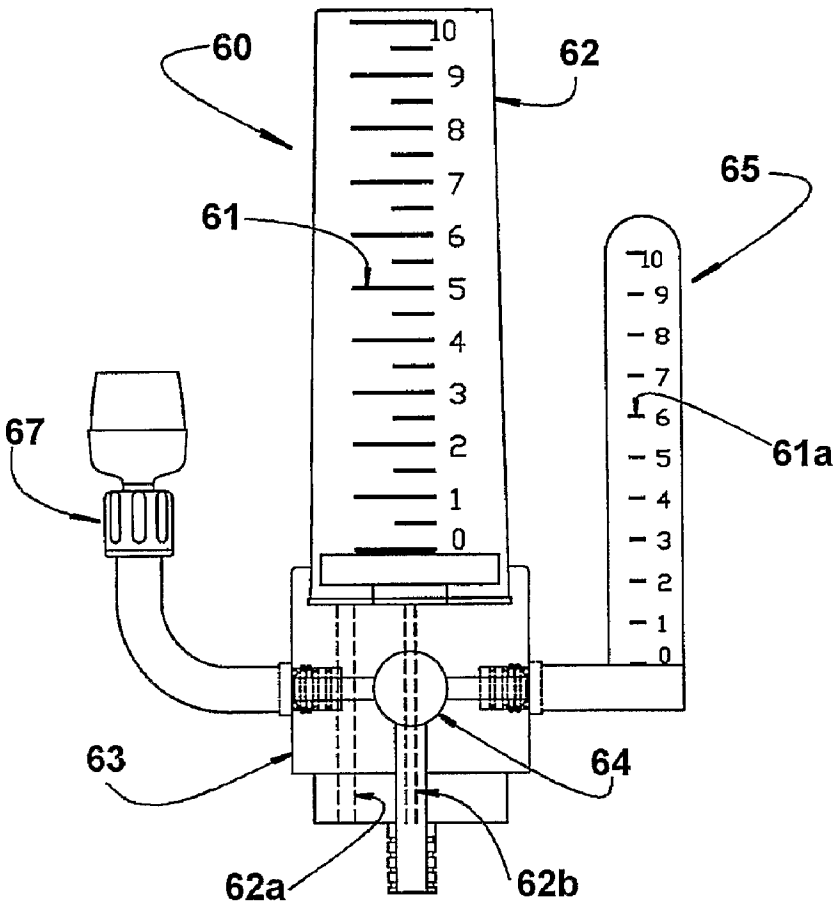

Showing the blade housings, the blades and the slots to receive the actuating keys;

FIGS. 8*a*, 8*b* and 8*c* represent three sectional views of the pump, showing the rotors, with their blades as if they were in motion (anti-clockwise) and also the pumped water inlet and outlet orifices;

FIG. 9 represents a sectional view of the pump, similar to that of FIG. 5, the position of the keys being such that the first rotor is operative, because it remains permanently connected to the shaft and the other two rotors are "disengaged" and, thus, inoperative;

FIG. 10 represents a view similar to that of FIG. 9, where the interior of the pump can be seen, with the components already described in FIG. 9, however the position of keys in this figure being such that the second rotor is operative, together with the first rotor, and the third rotor ins "disengaged" and, thus inoperative;

FIG. 11 represents a view similar to those of FIGS. 9 and 10, where the internal components of the pump can be seen, however in this figure the position of the keys is such that the second and third rotors are engaged and thus operative, together with the first rotor which is always operative;

FIG. 12, represents a schematic side view of the apparatus, illustrating the collector of the water coming from the pump, the conductors which, in this example, are represented by hoses and the display system comprising a base, a graduated transparent cup and a valve;

FIG. 13 represents a top view of the pump, illustrating the pumped water collector fixed thereupon and all the water conductor hoses thereof until the display;

FIG. 14 is a schematic representation, where the pump is shown in a top view, similar to that of FIG. 8 and with the water collector sectioned, showing its internal divisions and the display in a side view;

FIG. 15 represents a vertically sectioned schematic side view of the display system, illustrating its base, through which the conductor hoses enter and the larger graduated cup, on the top of the display, the side cup not being illustrated in this figure;

FIG. 16 represents a front and vertically sectioned schematic view of the display system, illustrating the components described in FIG. 15, plus the graduated transparent side cup, with the exhibition of the water inlet and outlet orifices of the graduated cups; and FIG. 17 represents a vertically sectioned schematic rear view of the display system.

DESCRIPTION OF THE ILLUSTRATED EMBODIMENT

The present invention presents an apparatus for in-water of the type which is at least partially submerged in water, such as a swimming-pool 1 containing a body of water 2, said apparatus comprising, generically: a structure 10, to be mounted at least partially submerged in water, for instance, in swimming-pool 1; an actuator mechanism 20 coupled to a structure 10 and to be displaced through the user's physical effort; a pump 30 submerged in the body of water 2 and comprising a housing 31, for instance, tubular, fixed to structure 10, journalling, internally, a shaft 32 on which at least one rotor 40 is mounted, coupled to shaft 32, for instance, in a permanent fashion, said shaft being coupled to the actuator mechanism 20, such as to be rotationally driven to pump water from the body of water 2. According to the illustrated embodiment, the water pump 30 is mounted on structure 10 submerged in the body of water 2.

The amount of rotors of the pump 30 determines possible scaled effort graduations for the user, also permitting an indication to the latter of certain demonstrative parameters of the effort decurrent from the exercise being practiced, such as speed, virtual distance traveled, etc.

In one embodiment of the present invention, such as that illustrated, the pump 30 is a multiple-stage pump and carries, journalled at its shaft 32, three rotors 40, 41, 42, for example, cylindrical, wherein only the first rotor 40 is coupled, in a permanent fashion, to the shaft 32.

Figure 1:
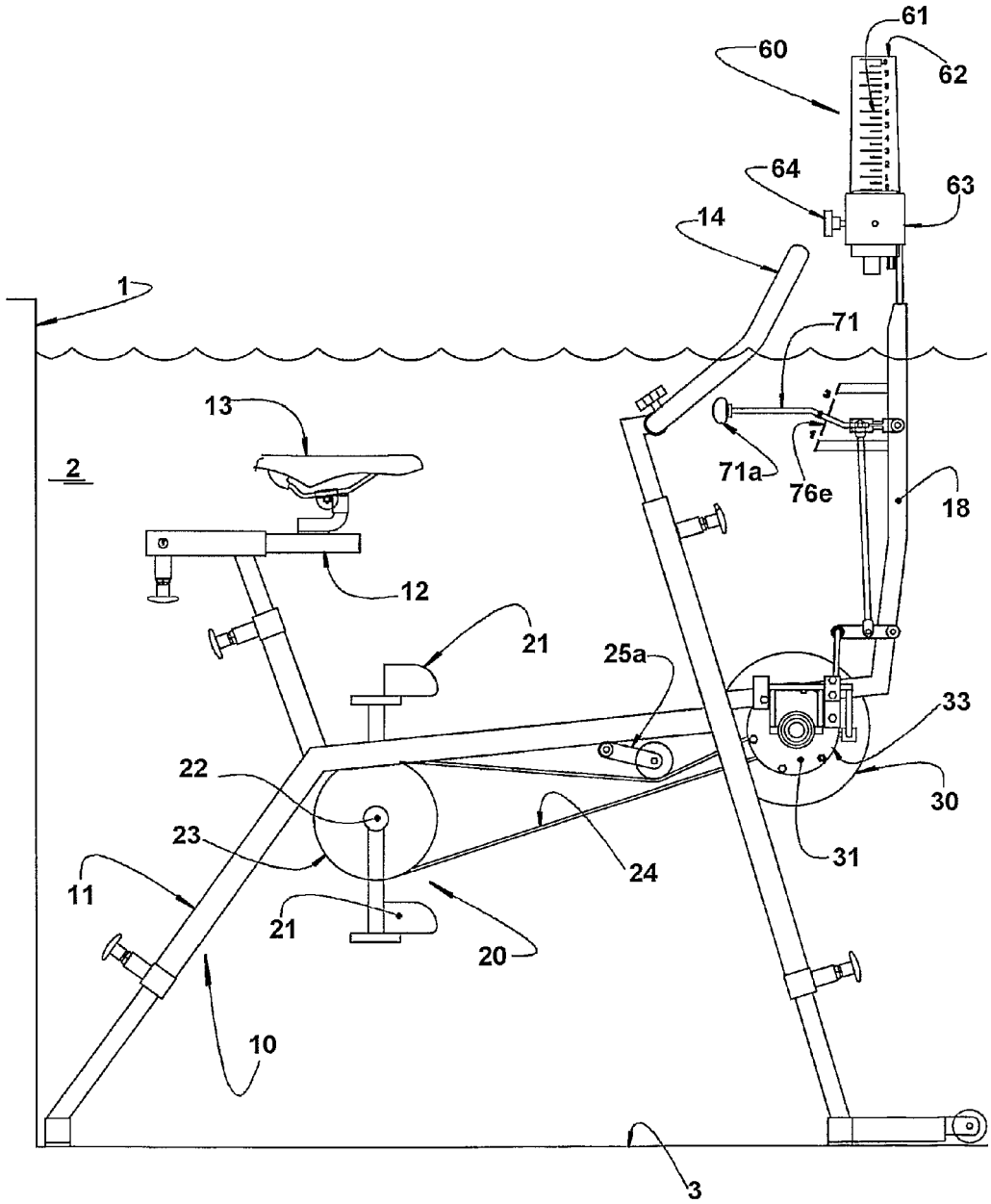
FIG. 1 represents a schematic side view of an apparatus in the form of an aquatic bicycle carrying a water pump built in accordance with the present invention and placed within a swimming-pool.

In one embodiment of the present invention, the actuator mechanism 20 is coupled to the structure 10 in a way such as to remain, at least partially, in a condition submerged in the body of water 2. In the illustrated construction, wherein the apparatus for exercises is a bicycle, the actuator mechanism 20 thereof is entirely submerged in said body of water 2. As illustrated in the attached drawings, the structure 10 of the apparatus for exercises of the present invention comprises a structural bicycle frame 11, supported on a portion of bottom wall 3 of the swimming-pool which contains the body of water 2, said structural bicycle frame 11 being disposed such as to be maintained substantially submerged in the body of water 2 of the swimming-pool 1, within a predetermined level (FIG. 1).

The apparatus for exercises of the present invention further comprises: a water collector 50 coupled to the housing 31 of the pump 30, to receive part of the water pumped by the first rotor 40 and by each one of the other rotors, if they exist, rotationally coupled to the shaft 32 to pump water; and a metering means 60 comprising at least one first display 61 fixed on the structure 10 and coupled to the water collector 50 in a way such as to indicate at least one of the outflow and volume parameters of water pumped by pump 30 and, thus, data of at least one of the respective operation speed and amount of exercise being accomplished by the user; a shift mechanism 70 carried by the structure 10 and coupled to the pump 30, in such a way as to permit the selective coupling and uncoupling of a second rotor 41 and a third rotor 42, relative to the shaft 32, through actuation by the user. According to the present invention, the remainder of the water pumped through the first rotor 40 and which has not been used by the metering means 60 returns to the body of water 2.

The user's action on the shift mechanism 70 to be described hereinafter, selectively couples the second rotor 41 and the third rotor 42 to the shaft 32, in such a way that each one thereof can be rotationally driven, when the actuator mechanism 20 is moved, pumping a respective water flow admitted in the pump 30, back to the body of water 2.

The apparatus of the present invention permits that the user's efforts be measured, utilizing therefor means related exclusively to the flow of water generated by the exercise.

The bicycle structural frame 11 can be constructed in several different manners and using different materials, and, in the illustrated example (FIG. 1), it assumes the shape of an armature, for example, metallic, provided with accessory support means 12, which sustain, for example: a seat 13; a handlebar 14; a pedal system of the actuator mechanism 20, comprising a pair of pedals 21; a pump 30; and a shifting lever 71 of the shift mechanism 70, to be described hereinafter. The pedal system of the actuator mechanism 20 further comprises an actuator shaft 22, transversely and horizontally journalled on structure 10.

Figure 2:
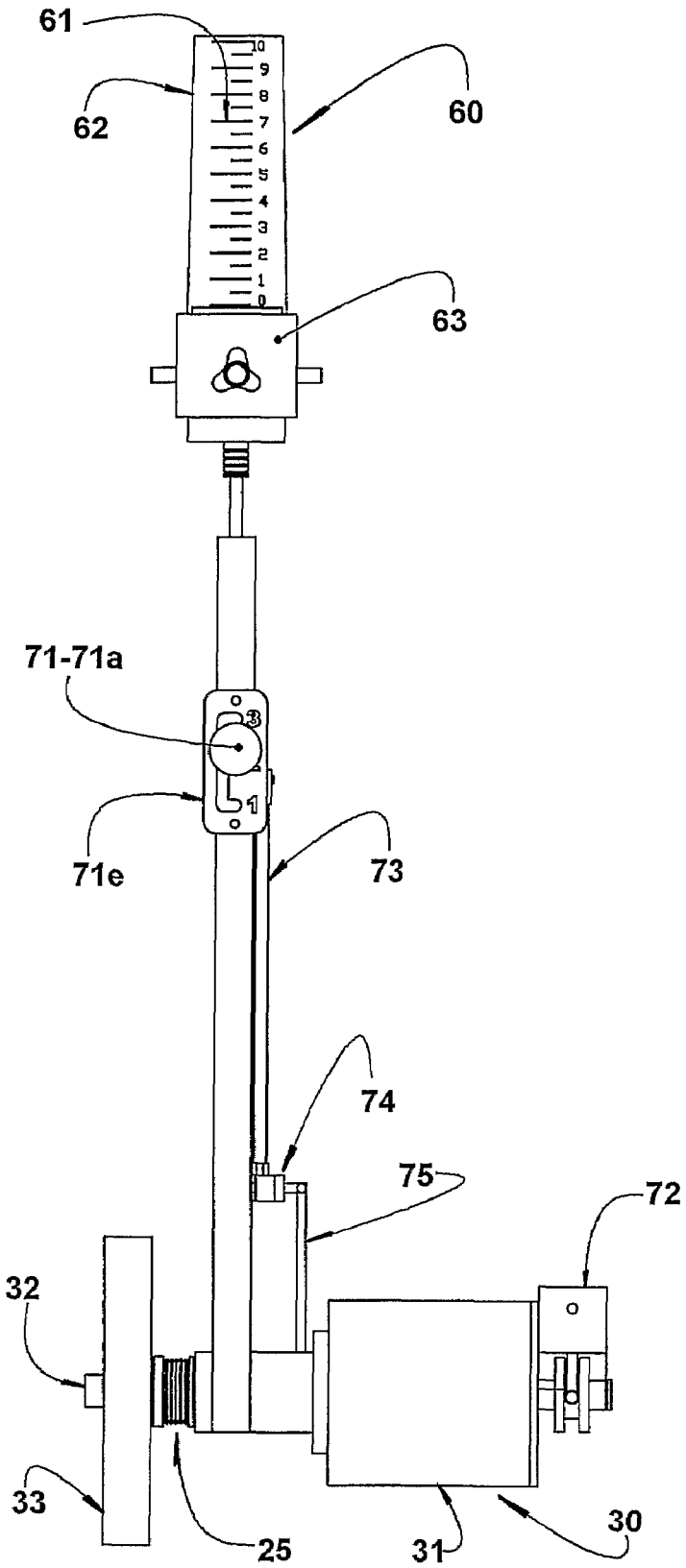
FIG. 2 represents a front view of the apparatus, taken from the point of view of someone who is on the bicycle.
Figure 4:
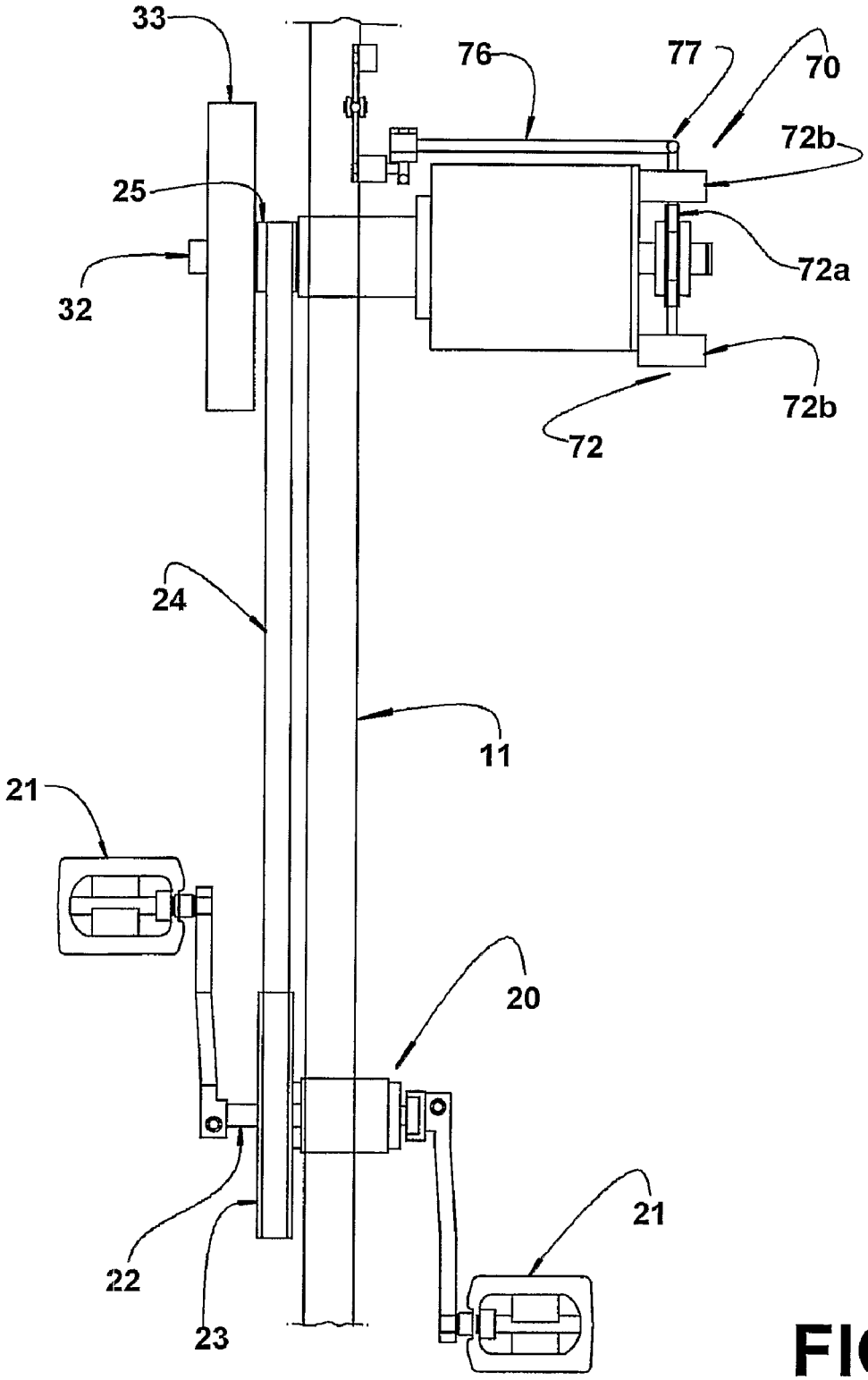
FIG. 4 represents a schematic partial top view of the apparatus, coupled to an actuator mechanism, in the form of a pedal system through a set of pulleys and a multi-V belt responsible for the transmission of movement to the pump, as well as the speed-select shifting lever.

The transmission of rotary movement applied by the user on the pedals 21 of the pedal system, is transmitted, through a drive pulley 23, which is engagingly fixed on the actuator shaft 22 of the pedal system and by means of a belt 24, (for example, a multi-V belt) to a driven pulley 25, passing by a stretcher pulley 25*a* such as exemplified and illustrated in FIGS. 1, 2 and 4. The driven pulley 25 and the belt stretcher pulley 25*a* have their horizontal shafts journalled on the structure 10, the shaft of the driven pulley 25 being defined by the shaft 32 of the pump 30.

The rotation thus transmitted is multiplied through the ratio between the diameters of the drive pulley 23 and the driven pulley 24, making the shaft 32 of the pump 30 rotate. An inertia flywheel 33, fixed to the shaft 32, makes the movement continuous and even, providing comfortable pedaling (FIGS. 1, 2 and 4).

A bearing 26, within which are placed two roller bearings 26*a* and two mechanical seals 26*b*, such as illustrated in FIG. 5, provides the connection between the housing 31 of the pump 30 close to a support extension 18 of the structure 10, particularly mounted on the latter, for instance, as a one-part assembly, at a front portion of said structure 10, positioned frontward relative to the user's position on the instant apparatus for exercises. The support extension 18 carries, at an end portion, the metering means 60, positioned such as to be easily visualized by the user, during the utilization by the user of the instant apparatus for exercises (FIGS. 1 and 2).

In one embodiment of the present invention, at least the second rotor 41, mounted on the shaft 32 of the pump 30, is selectively coupled with the latter, through the user's action, as explained hereafter, such as to be rotationally driven by the same in response to the movement of the actuator mechanism 20. In the illustrated construction, the second rotor 41 and the third rotor 42 are selectively and individually coupled with the shaft 32 of the pump 30, through the user's action on the actuator mechanism 20, said coupling altering the amount of water pumped by the pump 30 and, accordingly, the physical effort requirements from the user.

The housing 31 of the pump 30 is built such as to carry, internally housed, a determined amount of rotors 40 foreseen for a specific construction of an apparatus for exercises of the present invention. In the particular embodiment of the present illustrated invention, the housing 31 of the pump 30 is formed such as to house, internally, three rotors 40, 41, 42. In this case, a housing 31 is sized such as to carry within, vertical partitions 34, which divide the internal volume of said housing 31 in housing portions 31*a*, 31*b*, 31*c*, each one defining a respective chamber, said chambers being, for instance, differently sized, and shielding, in sequence, the first, the second and the third rotors 40, 41 and 42 (FIGS. 5, 6, 8*a*, 8*b* and 8*c*). The housing 31 is formed with different diameters along its larger shaft, against which are seated the partitions 34, defining respective internal chambers to receive, each one, a respective rotor. Each one of the first rotor 40, second rotor 41 and third rotor 42 is housed in a respective first, second and third housing 31*a*, 31*b*, 31*c* of the housing 31 of the pump 30, hydraulically separated one from the other.

In the embodiment of the present invention illustrated in the attached drawings, the housing 31 receives also an end cap 35, closing a last one of the housings of the rotors of said housing 31.

Each one of the first, second and third rotors 40, 41, 42 carries, within the housing 31 of the pump 30, a respective assembly of a plurality of first second and third blades 40*a*, 41*a*, and 42*a*, which are shielded and freely movable in first, second and third blade slots 40*b*, 41*b*, 42*b* and respective first, second and third blades 40*a*, 41*a*, 42*a* being in a number of four per rotor, as in the example illustrated in attached FIGS. 5, 6, 7*a*, 7*b*, 7*c*, 8*a*, 8*b*, 8*c*.

Each blade slot is defined in the shape of a radial slot produced from the peripheral edge of the respective rotor, for instance, from an outer peripheral edge of the respective rotor.

One of the rotors, for example, the first rotor 40 is permanently coupled with the shaft 32 of the pump 30, through the action of a first key 40*c* in a first key slot 40*d* radially defined from an internal peripheral border of said rotor 40, (FIGS. 5, 6, 8*a*, 8*b*, 8*c*). The second and third rotors 41 and 42 are provided such as to present free rotation about the shaft 32 of the pump 30, while they are not engaged with said shaft 32.

The rotary movement of the first, second and third rotors 40, 41 and 42 creates a centrifugal force that impels the respective first, second and third blades 401, 41*a* and 42*a* outwards, and these accompany, in their rotary movement, the geometry of the internal wall of the chamber formed by the housing portion 31*a*, 31*b*, 31*c* of the pump 30 housing the respective rotor. Since these chambers are eccentric of shaft 32 (FIGS. 8*a*, 8*b* and 8*c*), between each two consecutive blades 40*a*, 41*a*, 42*a* of a same rotor 40, 41, 42, a space is formed which increases as the rotor blades 40*a*, 41*a*, 42*a* move away from their respective rotor 40, 41, 42, sliding outwards from a bottom portion of their respective blade slot 40*b*, 41*b*, 42*b* and return, as said blades 40*a*, 41*a*, 42*a* come back close to their respective rotor 40, 41, and 42.

Therefore, the first rotor 40 permanently pumps water from the body of water 2, as long as it receives rotary movement from the actuator mechanism 20 of the apparatus for exercises, wherein the water coming from said first rotor 40 is directed, separately (FIG. 14) relative to the remaining consecutive rotors 42 and 42 in this example, to a first graduated cup 62 of the metering means 60, passing by a base 63 of the latter and being visualized by the user, through the first display 61 of said metering means 60, for instance disposed centrally on the support extension 18.

The first graduated cup 62 receives part of the water pumped by the first rotor 40, in such a way as to permit a visualization of the indicative value of the outflow of the water pumped by the first rotor 40.

Figure 3:
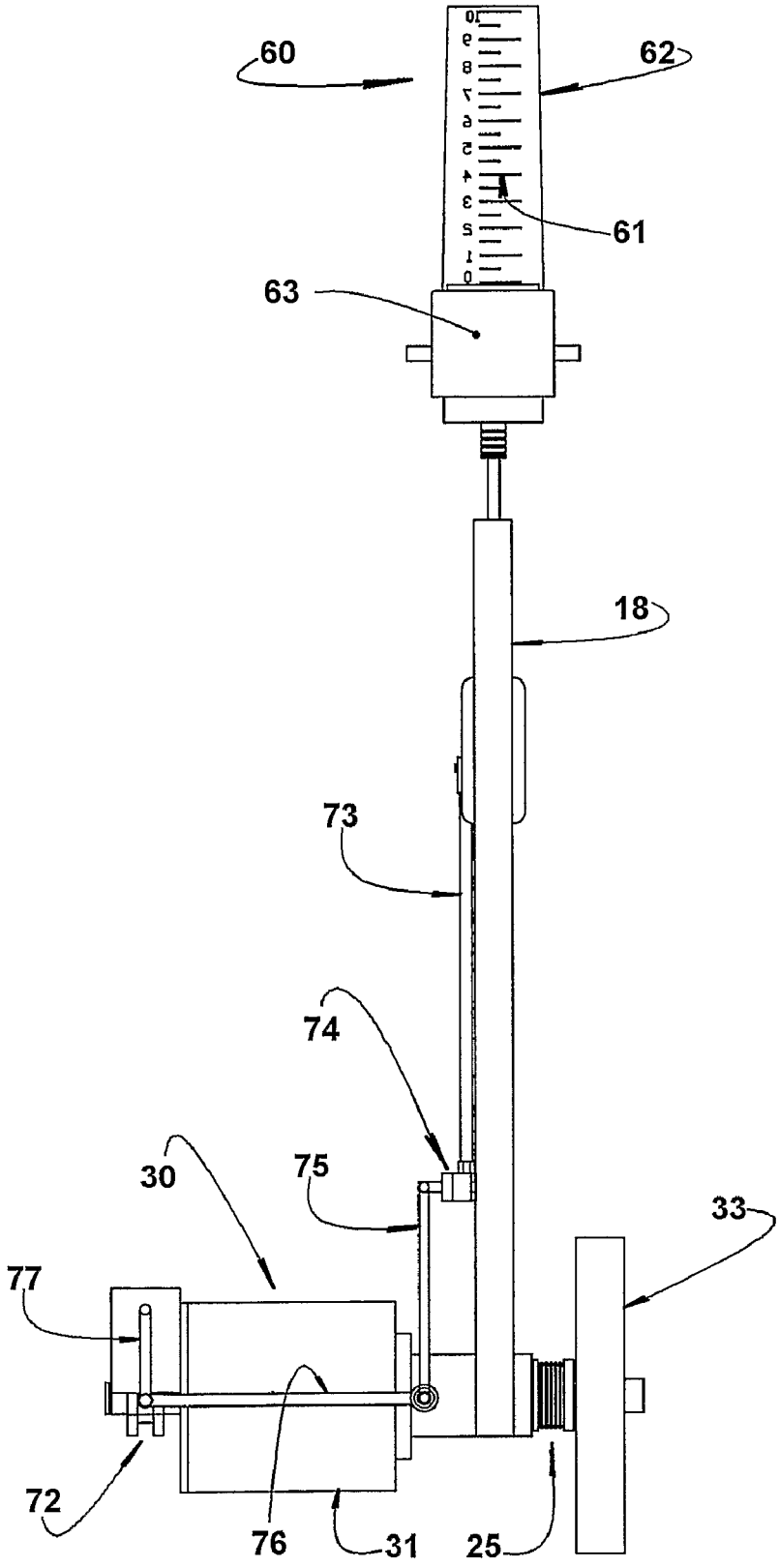
FIG. 3 represents a partial front view of the apparatus.

The first graduated cup 62 is provided with an inlet orifice 62*a* and an outlet orifice 62*b*, which can have their respective gage regulated by means of a regulating screw 64 (FIGS. 3, 16 and 17). The resulting outflow and decurrent from the difference between an input flow and an output flow of the first graduated cup 62 and that gives a measurement of the user's pedaling motion speed, wherein the rotation is always fixed for a determined level of said first graduated cup 62.

The water pumped by the first rotor 30 coupled with the shaft 32 of the pump 30 has further a by-pass to a second graduated cup 65 of the metering means 60, for instance, disposed laterally to the first graduated cup 62, as illustrated in FIGS. 16 and 17, which accumulates water in its interior, the amount of which is associated with a value of the virtual "distance traveled". At each re-initiation of the virtual distance traveled, the first graduated cup 62 and the second graduated cup 65 are emptied to begin to mark the new "course" from the user's effort on the apparatus for exercises of the present invention. In a constructive option of the present invention, the metering means 60 comprises a second display 61*a* defined in a second graduated cup 65 receiving part of the water being pumped from the first rotor 40.

The second graduated cup 65 can be disposed laterally to the first graduated cup 62, at the left or at the right thereof, coupled with a mouthpiece defined at the base 63, illustrated in FIGS. 1 through 3, 12, 14 and 15. The FIGS. 16 and 17 illustrate said second graduated cup 65 already mounted on a respective mouthpiece of the base 63.

According to a construction illustrated for the apparatus of the present invention, the first graduated cup 62 meters the pedaling speed and the second graduated cup 65, that accumulates water, simulates a speedometer, i.e., the measurement of a virtual course.

The water level in the first graduated cup 62, at each moment of the exercise, corresponds to a determined number of pedals per minute, (applied rotation) and can be regulated, by means of the regulating screw 64, located in front of the first display 61 of the first graduated cup 62. This regulating screw increases or reduces the water output from the first graduated cup 62, making the exercise respectively "heavier" or "lighter" (FIGS. 16 and 17).

Further to the input orifice 62*a*, for input of water coming from the first rotor 40, the output orifice 62*b*, for the output of water from the graduated cup 62, an additional water inlet, for water coming from the other rotors 41, 42.

According to a particular construction of the apparatus object of the present invention, the shift mechanism 70 selects "speeds", like in a motor vehicle, wherein each "speed" corresponds to a rotor of the pump that is engaged with the shaft of the latter, passing from one position of free rotation about the shaft of the pump, and a position engaged to the latter, causing that the instant rotor begins pumping water. This speed shifting system of the shift mechanism 70 is formed from a shifting lever 72, a shift primary vertical rod 73, a shift multiplier arm 74, a shift intermediate vertical rod 75 (FIG. 2), a shift horizontal rod 76, and a shift final vertical rod 77 (FIGS. 3 and 4) which will be described hereunder.

To increase the effort required by the exercise, a gradual engagement of rotors, further to the first rotor 40, is used. For the construction of the illustrated apparatus for exercises, the effort graduation is obtained through the engagement of one or two of the rotors 41, 42, further to the first rotor 40. To engage the second rotor 41, the user moves the shifting lever 71, by means of its handle 71*a*, from an inoperative condition, where said shifting lever 71 is in a lowered position, to an operative condition, where said shifting lever is raised until an intermediate raised position. In the inoperative condition, the shifting lever 71 does not allow the engagement of the other rotors 41, 42.

The shifting lever 71 is pivoted on structure 10, through its pivoting directly to the length of the support extension 18 of said structure 10, so as to be displaced by the user between an inoperative condition, disengaged from the second and third rotors 41, 42 to the shaft 32 of the pump 30 and an operative condition, where each one of said second and third rotors 41, 42 is selectively engaged to the shaft 32. When the shifting lever 71 is conducted from the inoperative condition to the operative condition, the shift primary vertical rod 73 is moved vertically up, because it is connected, by means of a first pin 71*b* (or another system that permits its pivoting) and a transmitter arm 71*c*, that, itself, pivots about a second pin 71*d* connected to the support extension 18 (FIGS. 1, *e* and 4*a*).

The shift primary vertical rod 73 is pivoted about the shift multiplier arm 74 through a third pin 73*a* and the shift multiplier arm 74, it is pivoted about the length of the support 18 by a fourth pin 74*a* and a fifth pin 74*b*.

Figure 4A:
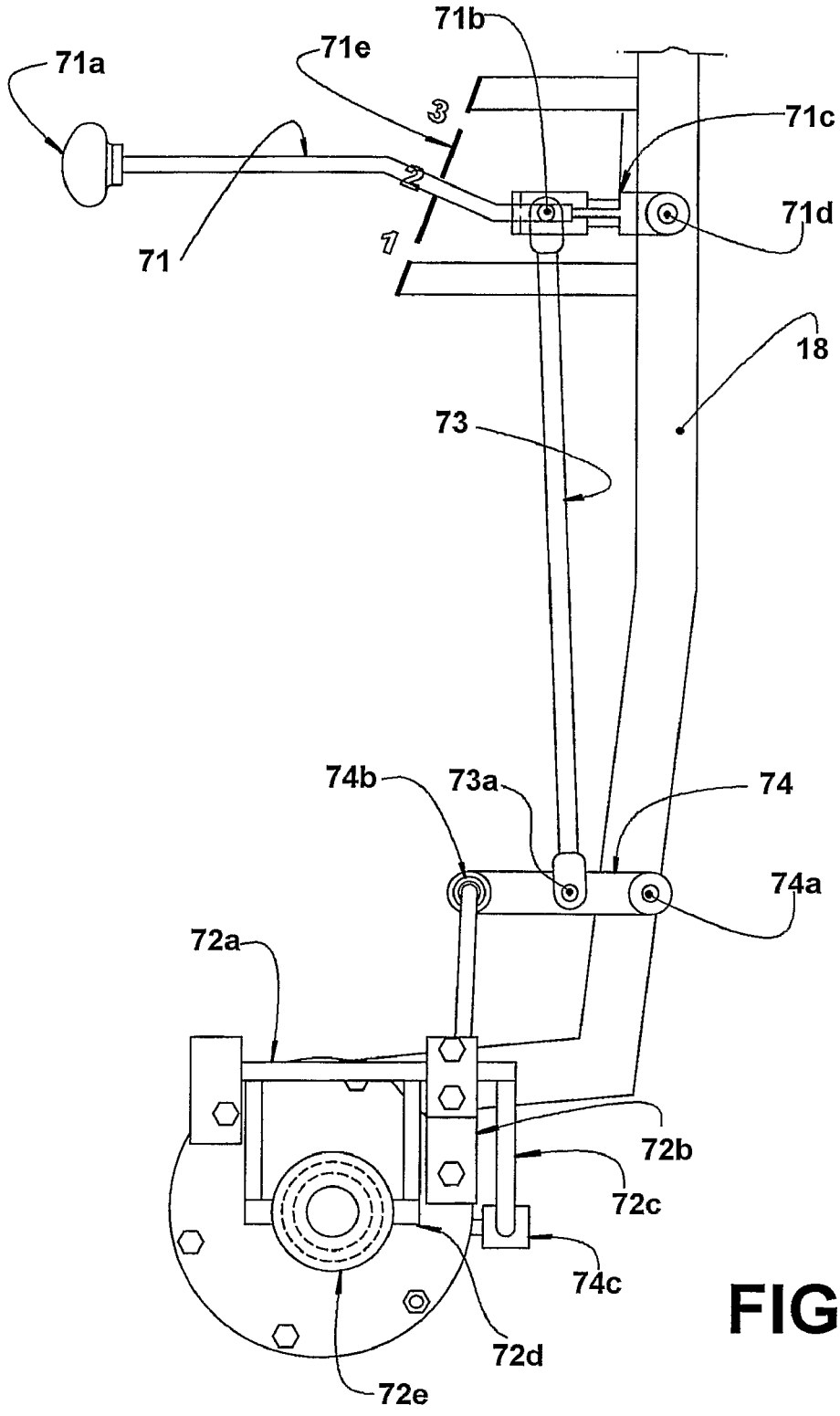
FIG. 4*a* represents a schematic side view of the apparatus, partially illustrating the shift mechanism including the shift lever and the connection rods of the speed-engagement system.

The vertical movement of the shift primary vertical rod 73, makes the shift multiplier arm 74 rotate about the first pin 71*b*, fixed to an extension of the support 18. Through this rotating movement, the shift multiplier arm 74 causes the multiplication of the angle to which the shifting lever 71 was submitted, at a ratio equal to distance between the third pin 73*a* and the fifth pin 74*b* and the distance between said third pin 73*a* and the fourth pin 74*a*. The transmission of the movement proceeds until the shift intermediate vertical rod 75, that is connected, by means of a ball joint that defines the fifth pin 74*b*, to the shift multiplier arm 74 (FIG. 4*a*). The shift intermediate vertical rod 75, moving upwards, will carry with itself the shift horizontal rod 76, which is also connected through a ball joint 74*c*. The shift final vertical rod 77, which is rigidly connected to the shift horizontal rod 76, effects an angular movement, causing to rotate, of the same angle, a shift shaft 72*a* of the shifting lever 72, which is supported on a pair of bearings 72*b*, each bearing being mounted on an end of said shift shaft 72*a*.

Figure 6:
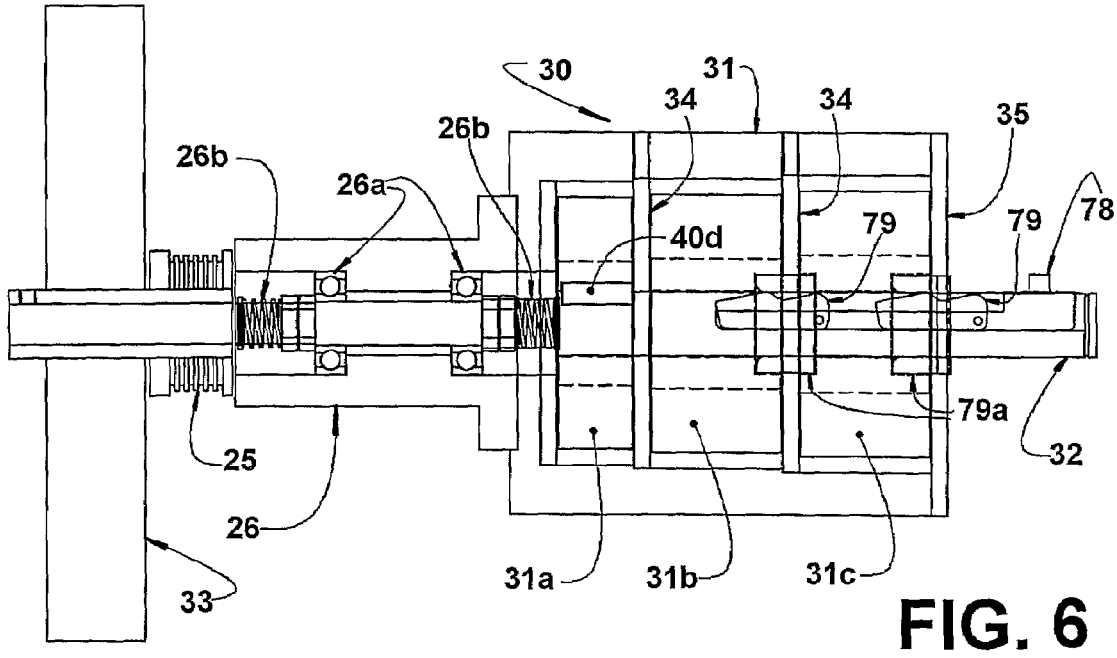
FIG. 6 represents a sectional view of the pump, similar to that of FIG. 5, detaching other elements of the latter.
Figure 6A:
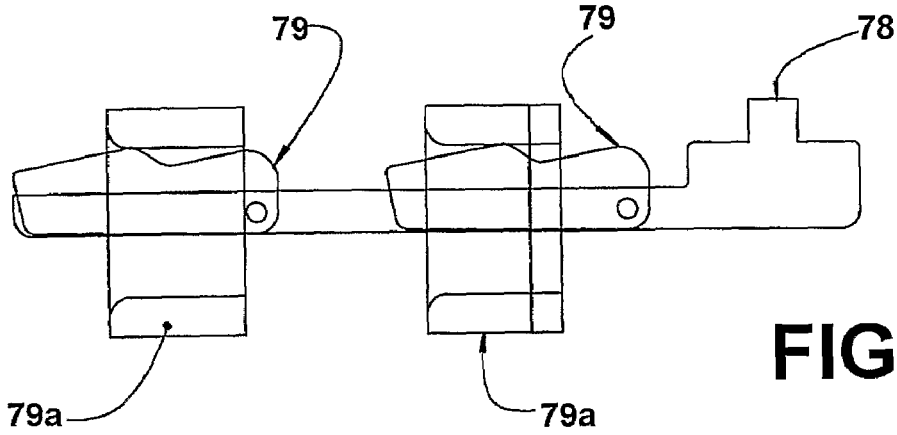
FIGS. 6*a*, 6*b* and 6*c* represent side views of the key assembly, with a sliding key, the actuating keys fixed thereon, the springs of the keys and the compressing rings.
Figure 6B:
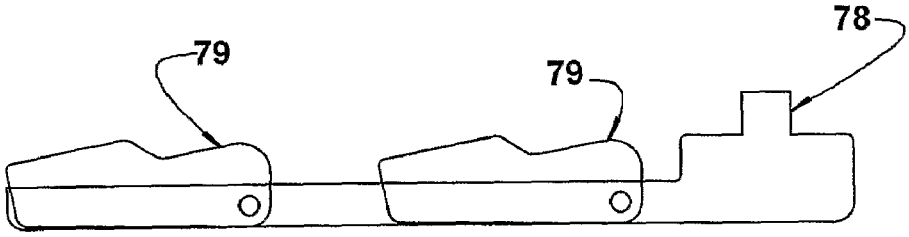
Figure 6C:
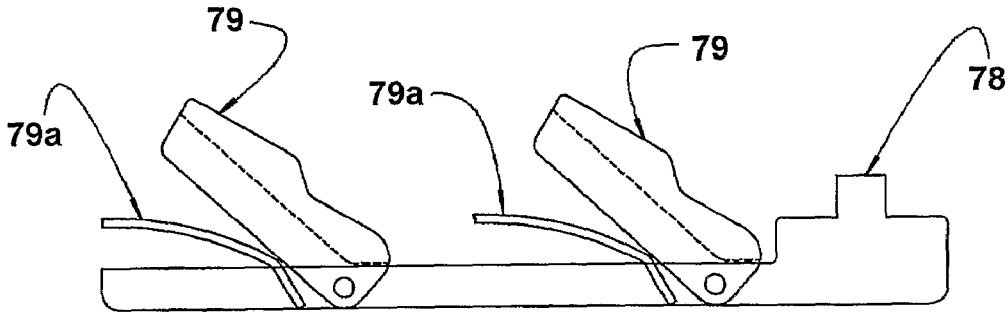
Figure 7A:
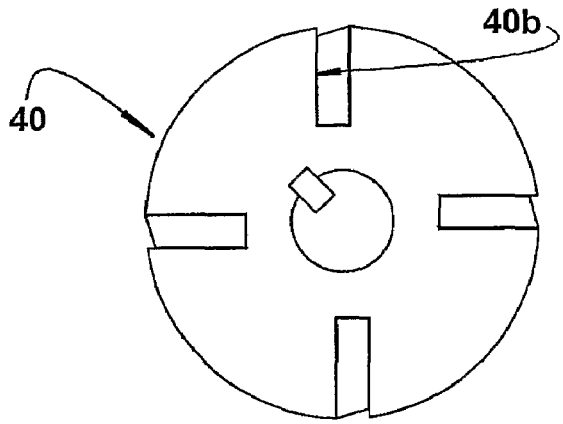
FIGS. 7*a*, 7*b* and 7*c* represent side views of the rotors.
Figure 7B:
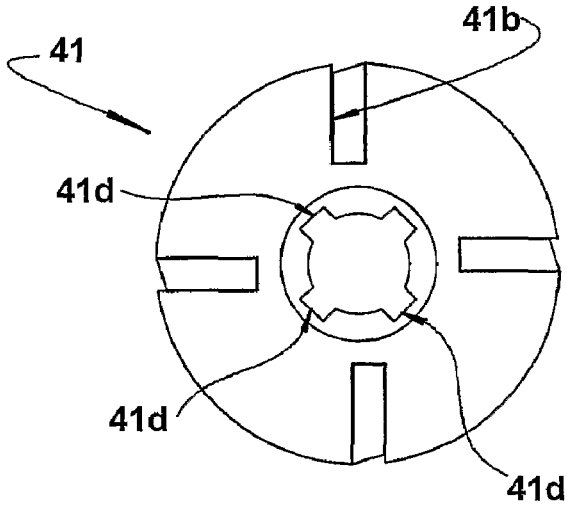
Figure 7C:
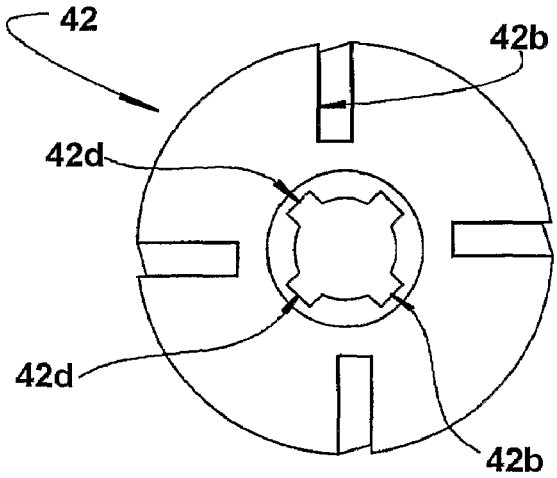

Rigidly connected to the shift shaft 72*a*, are actuator forks 72*c* (FIG. 4*a*) which, through respective ends 72*d*, will transmit to a sleeve 72*e* a rectilinear movement, into the shaft 32 of the pump 30, compensating the angular movement of the actuator forks 72*a* for a vertical displacement of its ends 72*d* relative to the sleeve 72*e* (FIGS. 2, 4 and 4*a*). The sleeve 72*e* will then push, into the shaft 32 of the pump 30, a sliding key 78 (FIG. 6), which carries with it actuating keys 79, each one of which can engage a respective rotor other than that permanently coupled with the shaft 32 of the pump 30. In the previous position, before the beginning of the engagement operation, a compressing ring 79*a*associated with each respective actuating key 79 (FIG. 6) maintains each said respective actuating key 79 pressed against a respective spring 79*b* (FIGS. 6*a*, 6*b*, 6*c*), in a lowered position and, therefore, without engaging with the rotors. When the first shift occurs, the movement of the sleeve 72*e* described hereinabove will cause that the actuating key 79 overcomes the point where respective compressing ring 79*a* maintained it pressed, thus releasing said actuating ring 79 outwards from the shaft 32, such that it will find the first slot 41*b* of a rotor 41, subsequent to the rotor 40 permanently coupled with the shaft 32 of the pump 30, and which defines a second rotor 41 in the illustrated sequence, causing that said second rotor 41 rotates engagingly with the shaft 32 (FIGS. 7*a*, 7*b*, 7*c*, 8*a*, 8*b*, 8*c*).

Likewise, for the next other rotor 42 to be engaged and, thus, to increase the outflow of water and the effort required from the user, the shifting lever 71 must be moved to another position, higher than the intermediate position. When this occurs, the entire process described is repeated, now for this third rotor 42 in the illustrated sequence, with its actuating key 79 from the respective compression ring 79*a*, allowing that said actuation key 79 engage in the slot 42*d* of the second rotor 42, which also goes into engagement rotation with the shaft 32 of the pump 30, adding its outflow to the outflow of the previous rotors already engaged with the shaft 32 of the pump 30 (first rotor 40 and second rotor 41).

It should be noted that the outflows are always additional and, thus, the required effort is increased. However, the flow generated by the first rotor 40 is collected separately by a first chamber 51 if the collector 50 and serves to measure, indirectly, through the flow of water, (input minus output) in the first graduated cup 62, the rotational speed of the instant apparatus as well as to measure, also indirectly, the "traveled distance", through the water accumulated in the second graduated cup 65 (in this cup there is no exit and, therefore, water accumulates, until he operator wishes to reset it, rotating it forwards and emptying its contents in order to initiate a new measurement) (FIGS. 14, 15, 16 and 17).

The positions of the shifting lever relative to the engagement of the first rotor 40, of the second rotor 41 and of the third rotor 42 are obtained through the actuation of said shifting lever 71 to corresponding positions on a shift panel 71*e* provided mounted on the support extension and presenting a lever retaining recess for each corresponding rotor of the pump. In the illustrated embodiment and considering the example of a three-rotor pump, the shift panel 71*e* presents three lever retaining recesses, wherein the first recess, positioned below the other in the illustrated construction, corresponding to the permanent engagement of the first rotor 40. The intermediate recess of the shift panel 71*e* corresponds to the engagement of the second rotor 41 and the top most recess in the illustrated construction corresponds to the engagement of the third rotor 42. It should be understood that that the shift panel can present a different configuration from that illustrated, for instance, a horizontal arrangement of lever retaining recesses or, further, a circular arrangement, as long as said arrangements indicate to the user the sequence of rotor engagements or of the increase in exercise load which they represent. In a particular embodiment, these arrangements are sequential, as illustrated.

As can be observed in FIG. 14, the water pumped by the first rotor 40 is received separately in the collector 50, while the water from the other rotors 41 and 42 are collected together.

Through the first chamber 51 of the collector 50, fixed on the housing 31 of the pump 30, the water pumped by the first rotor 40, is directed to a first hose 52, that conducts to a base 63 of the first display 61, through which water enters, through the input orifice 62*a* and through a by-pass, afterwards reaching the second graduated cup 65 (FIGS. 12, 13, 14, 15, 16 and 17).

On the other hand, the flow coming from the second rotor 41 or the flow therefrom and further that from the third rotor 42, is collected in a second chamber 53 of the collector 50 and directed, through a second hose 54, until the inlet 62*a* of the first display 61, from where said water can then be directed, by a valve 66 to, for instance, a lateral, or frontward fountain 67, to a squirt, which is coupled with a nipple 68.

The functioning of the apparatus for exercises of the present invention occurs as described hereafter: the movement effected by the user on the actuator mechanism of the apparatus for exercises of the present invention is transmitted by a belt (or another means available and which is more appropriate, such as a chain, a cable, an eccentric rod, etc.) to the shaft 32 of the pump 30, which is positioned eccentrically relative to the housing 31 of the latter. The rotary movement of the shaft 32 of the pump 30 makes the first rotor 40 rotate, which is connected to the shaft 32 through a key or any other suitable fixing means, rotating said first rotor 40, at the same frequency as that of shaft 32. This first rotor 32 has a cylindrical shape, with radial slots which shield, each slot, a rectangular equally sized as the slot and lying freely within the space formed by the slot and the partitioning lids side-by-side with each rotor. Since the first rotor 40 is positioned eccentrically relative to the housing 31 of the pump 30, the chamber formed therearound, also cylindrical, are built such that at one point of this chamber the first rotor pass very close to the internal wall of said chamber, thus forming a space that first opens and then splays. When the rotary movement in applied to the first rotor 40, through the shaft 32 of the pump 30, its blades are submitted to a centrifugal radial force causing that they be impelled against the internal wall of the respective housing portion 31*a* of the pump 30, thus forming a space contained by this wall, by the first rotor 40, by the partitions of the other second and third rotors 41, 42 and by the respective blades thereof, that at each rotation move radially, out and into the respective slot, according to the position relative to the internal wall of the respective housing portion of the pump 30. The water inlet is positioned on the housing of the pump at the point where the rotor and the housing of the pump divert, causing that the space between the blades increases, creating a sub-pressure condition and causing that the water enters the pump 30. Thereafter, continuing the rotation of the first rotor 40, the space contained between two subsequent blades splays, creating a positive pressure which will expel the water from the pump 30 through the outlet orifice defined on the housing 31 of the pump 30 at the point where the space between the external wall of the pump 30 and the first rotor 40 is splayed. The water pumped by this first rotor 40 us conducted to the metering means 60, to its displays, such that, through the difference between the input flow and the output flow from the first graduated cup 62 of said metering means 60, provides a measurement of the speed, in revolutions per minute, which is necessary to maintain the water at a certain level of said graduation. The second graduated cup 65 only accumulates water in its interior, simulating a "travelled distance", which can be emptied do initiate marking a new stretch.

This process is repeated for each one of the other pump rotors 41, 42, with the difference that the second and the third rotors 41, 42 and other subsequent ones, if existent, are not engagingly connected to the shaft 32 of the pump 30 and, therefore, do not rotate together with the shaft 32, except when they are "engaged", through the actuation of a shift mechanism 70, like in a speed-stepping system. When this occurs with each rotor, it also starts pumping water. This water, pumped by the rotors subsequent to the first rotor 40, is collected together, however separate from that originated from the first rotor 40 and conducted to the valve at the base of the display, where the user can select if it will go to a fountain or to a squirt, for the sake of entertainment. In other words, the efforts required by the user are increased as each new rotor is engaged and its output is also always added to the output of the previous rotors, except that of the first rotor 40, which output, as already mentioned, is directed exclusively to the metering means 60, for a measurement of the rotation corresponding to its output.

The functioning of the speed-stepping system is as follows:

Having the shifting lever 71 been shifted for a determined rotor, its rectilinear displacement is transmitted by the intermediate rods 75, that modify the direction and the course of this displacement, until the sliding key 78, that is inserted in a longitudinal slot existent on the shaft 32 of the pump 30. On this sliding key 78, are connected other keys, said actuating keys 79, at one end by a pin that trespasses the sliding key 78 and at the other on a spring, such that these actuating keys 79 are forced out from the shaft 32. In a specific position, relative to each rotor, there is a compressing ring that rotates accompanying the shaft 32 of the pump 30 and that lets the sliding key 78 and the actuating keys 79 pass underneath, in the space comprised between the ring and the slot of the of the shaft 32. These rings press the actuating key 79 of each rotor, against the shaft 32, forcing its spring, when it is in the inoperative position. This way, the user engages the corresponding rotor and the sliding key 78 displaces carrying with it the actuating keys 79. When overtaking the corresponding compressing ring, the key of the rotor in question is released and the spring makes it move radially outwards from the shaft 32, in the direction of the slots existent in the center of the rotor; when it finds the first slot, it fits therein and the rotor is thus engaged, now rotating engagingly with the shaft 32 of the pump 30 and contributing to the increase in the outflow of pumped water and of the effort required from the individual who is exercising himself.

The invention claimed is:

1. Apparatus for in-water exercises, comprising;

a structure to be at least partially submerged in a body of water;

an actuator mechanism with at least one crack being actuator by at least one of pedaling, treading, stepping, rotating and pulling exercises, couple to the structure and movable through an user's effort;

a pump submerged in the body of water and comprising a housing fixed to the structure and internally journaling a shaft on to which a first rotor is mounted coupled to the shaft, at a first housing portion and at least one second rotor is also mounted so as to be selectively coupled to the shaft, in a respective second portion of the housing, hydraulically separated from the first portion of the housing, said shaft being coupled to the actuator mechanism, whereby to be rotationally driven, to pump water;

a water collector coupled to the first portion of the housing of the pump, to receive part of the water pumped by the first rotor; and a metering means comprising at least one first display fixed onto the structure and coupled to the water collector, whereby to indicate at least one of the outflow and volume of water pumped through the pump and, thus, at least one of the respective operation speed and amount of exercise being practiced, said second rotor being selectively coupled with said shaft by action of the user, such as to be rotationally driven in response to the motion of the actuator mechanism, pumping a respective flow of water admitted in the pump, back to the body of water; and a shift mechanism carried by the structure and coupled with the pump, so as to selectively allow couple and uncoupling of the second rotor relative to the shaft, by action of the user.

2. Apparatus, according to claim 1, wherein the body of water is defined in a swimming-pool.

3. Apparatus, according to claim 1, wherein a remainder of the water pumped by the first rotor is returned to the body of water.

4. Apparatus, according to claim 1, wherein the first rotor is permanently coupled with the shaft, whereby to rotate with the shaft.

5. Apparatus, according to claim 1, wherein the pump is submerged in the body of water.

6. Apparatus, according to claim 1, wherein the first display of the metering means is defined by a first graduated cup receiving part of the water pumped by the first rotor, so as to allow a visualization of an indicative value of the outflow of water being pumped by the first rotor.

7. Apparatus, according to claim 6, wherein the metering means comprises a second display defined by a second graduated cup, receiving part of the water pumped by the first rotor, so as to allow the visualization of a value indicative of the volume of water being pumped by the first rotor.

8. Apparatus, according to claim 5, comprising:

an inertia flywheel coupled with the shaft of the pump; a plurality of blades slidingly shielded in slots provided on the rotors, said blades being displaced by action of centrifugal force and forming chambers between each other and with a housing of the pump during the rotation of the rotors.

9. Apparatus, according to claim 1, comprising a shift mechanism constituted by:

a shifting lever operatively coupled with the structure, so as to be moved by the user between an inoperative condition, of disengagement of the second rotor and a third rotor with the shaft of the pump and an operative condition, of selective engagement of each of said second and third rotors with the shaft; a shift primary vertical rod operationally coupled with the structure, by means of a transmitter arm, so as to receive herefrom a movement transfer from the shifting lever; and a shift multiplier arm, pivoted to the shift primary vertical rod so as to be rotated by the shift primary vertical rod, multiplying, by a determined value, a rotation angle to which the shifting lever was submitted.

10. Apparatus, according to claim 1, wherein the water collector presents a first and a second chamber separated from each other, each one being coupled through a respective first and second hoses, to the first display.

11. Apparatus, according to claim 6, wherein the first graduated cup presents an inlet orifice, for the entry of the water coming from the first rotor, an outlet orifice, for the exit of the water from the first graduated cup and an additional water inlet, for the water coming from at least the second rotor.

12. Apparatus, according to claim 1, wherein by presenting stepped multiple stages, formed by the rotors coupled with the shaft of the pump, wherein the rotors rotate eccentrically about said shaft.

13. An apparatus according to claim 1, wherein the water pumped by the at least one second rotor is in communication with at least one of a fountain and a squirt nipple.

* * * * *